US008632220B2

(12) United States Patent
Lee

(10) Patent No.: US 8,632,220 B2
(45) Date of Patent: Jan. 21, 2014

(54) LED STREET LAMP AND A STREET LAMP FIXING DEVICE

(75) Inventor: Ke-chin Lee, Taipei (CN)

(73) Assignee: Zhongshan Weiqiang Technology, Co., Ltd., Guangdong (CN)

( * ) Notice: Subject to any disclaimer, the term of this patent is extended or adjusted under 35 U.S.C. 154(b) by 189 days.

(21) Appl. No.: 13/264,383

(22) PCT Filed: Feb. 11, 2010

(86) PCT No.: PCT/CN2010/070628

§ 371 (c)(1),
(2), (4) Date: Oct. 13, 2011

(87) PCT Pub. No.: WO2011/079544

PCT Pub. Date: Jul. 7, 2011

(65) Prior Publication Data

US 2012/0033425 A1 Feb. 9, 2012

(30) Foreign Application Priority Data

Jan. 1, 2010 (CN) ..... 2010 1 0019244

(51) Int. Cl.
*F21V 33/00* (2006.01)

(52) U.S. Cl.
USPC ..... 362/294; 362/373; 362/800; 362/249.02; 362/249.1

(58) Field of Classification Search
USPC ..... 362/249.02, 249.1, 249.11, 294, 800, 362/373
See application file for complete search history.

(56) References Cited

U.S. PATENT DOCUMENTS

| | | | | |
|---|---|---|---|---|
| 7,780,320 | B2 * | 8/2010 | Hu et al. | 362/431 |
| 8,128,258 | B2 * | 3/2012 | Lodhie | 362/249.02 |
| 8,164,238 | B2 * | 4/2012 | Lee | 313/46 |

* cited by examiner

*Primary Examiner* — Anabel Ton
(74) *Attorney, Agent, or Firm* — Novak Druce Connolly Bove + Quigg *LLP*

(57) ABSTRACT

A street lamp fixing device includes a LED module, a heat dissipation device, a lamp holder, a metal plate and a connector. The heat dissipation device has a lamp holder mounting recess cooperating with the metal plate for locking the lamp holder. Moreover, an LED street lamp with natural convection devices accelerates the airflow within the street lamp to a faster speed to enhance heat exchange, whereby the lifespan of the LED street lamp is extended and the weight and size of the street lamp are reduced.

9 Claims, 5 Drawing Sheets

LED STREET LAMP AND A STREET LAMP FIXING DEVICE

CROSS-REFERENCE TO RELATED APPLICATIONS

This application is filed under 35 U.S.C. 371 as a U.S. national phase application of PCT/CN2010/070628, having an international filing date of 11 Feb. 2010, which claims the benefit of Chinese Patent Application No. 201010019244.6, having a filing date of 1 Jan. 2010, both of which are hereby incorporated by reference.

TECHNICAL FIELD

The present invention relates to a large LED street lamp, and more particularly to a heat dissipation device and a fixing device for a large street lamp.

BACKGROUND

At present LED lamps have been widely used in street lighting, as usually lighting streets requires high illumination brightness, wide illumination angles and long illumination distances, in order to satisfy these conditions, a plurality of LED chips connected all together are used in a single LED street lamp, thus, the size and weight of the whole device are increased. At the same time these LED chips will generate a great deal of heat in operating, requiring a corresponding heat dissipation device which requires lots of open space as well. Furthermore, as the conventional heat dissipation devices used in LED street lamps are usually heat sinks made of metal materials, more heat dissipating capacity provided means larger size and greater weight. Under these circumstances, the lamp holder must be redesigned to conform to the overweighed lamp. However, for the common lamp holders, for example, E40, its maximum load has been limited by its structure, if the weight of the lamp exceeds the maximum load of the holder, the connection may come unstable, the lamp may fall down from the holder, and the holder may be damaged.

Recently some relevant products in the market have been redesigned, for example in U.S. patent 2006/0067076A1, the supporting structure of the LED street lamp is enhanced to some extent, but these products still cannot fully satisfy the requirements of the LED street lamps with increasing weight and size.

SUMMARY OF THE INVENTION

In consideration of the facts that the conventional LED street lamps have bad quality, excessive size and weight, and great deal of heat generated in operation, the present invention discloses a complete set of solutions for LED street lighting.

The LED street lamp disclosed by the present invention comprises:

an LED module;

a heat dissipation device secured on the back side of the LED module;

a first natural convection device disposed between the LED module and the heat dissipation device, and actuated by air natural convection generated by the temperature difference between the LED module and the outside of the street lamp;

a second natural convection device disposed outside the LED module and the heat dissipation device, and actuated by air natural convection generated by the temperature difference between the LED module and the heat dissipation device; and a shaft mounted between the LED module and the heat dissipation device along a longitudinal direction, and connecting the first and second natural convection devices.

Moreover a street lamp fixing device disclosed by the present invention comprises:

an LED module;

a heat dissipation device secured on the back side of the LED module;

a standard circular lamp holder with an internal thread;

a semicircular-arc-like metal plate with an connecting lug on either side thereof;

a connector electrically connecting the LED module and the lamp holder, and with an external thread corresponding to the internal thread of the lamp holder; the heat dissipation device has a hemispherical lamp holder mounting recess cooperated with the metal plate, to form a locking hole for wrapping and locking the lamp holder; the connecting lugs are respectively fixed on the opposite sides of the lamp holder mounting recess.

The first natural convection device according to the present invention is actuated by air natural convection caused by the temperature difference between the LED module and the exterior of the lamp, while the second natural convection device is actuated by air natural convection generated by the temperature difference between the ELD module and the heat dissipation device. These two devices accelerate the airflow of the whole street lamp to a higher speed, allowing faster heat exchange and better consequent heat dissipation, as well as extending the life span of the street lamp, and facilitating its assembly and use while reducing its weight and size. In addition, in the present invention the lamp holder as a fixing end connects the lamp body which consists of the LED module, heat dissipation device and connector, to a lamp base, for this purpose the lamp holder is wrapped and locked by the metal plate and the lamp holder mounting recess located on the tail of the heat dissipation device, whereby the whole LED lamp is able to bear a greater weight. Moreover, with the structure disclosed by this invention, the installation of LED street lamps is simplified as well.

DENOTATION OF THE DRAWINGS lamp holder: 101, 201

LED module: 102, 202 heat pipes: 1021
LED chips: 1022
circular tube: 1023
circuit board: 1024
opening: 1025
tube cover: 1026
heat dissipation devices: 103, 203
lamp holder mounting recess: 1031, 2031
semicircular-arc-like metal plate: 104, 204
connector: 105, 205
insulating ring: 1051,2051
electrically connecting site: 2052
the first natural convection device: 106, 206
the second natural convection device: 107, 207
shaft: 108, 208
rotation connector: 1081, 2081
transparent protective covering : 209
connecting lugs: 2041

DETAILED DESCRIPTION

Figure 1:
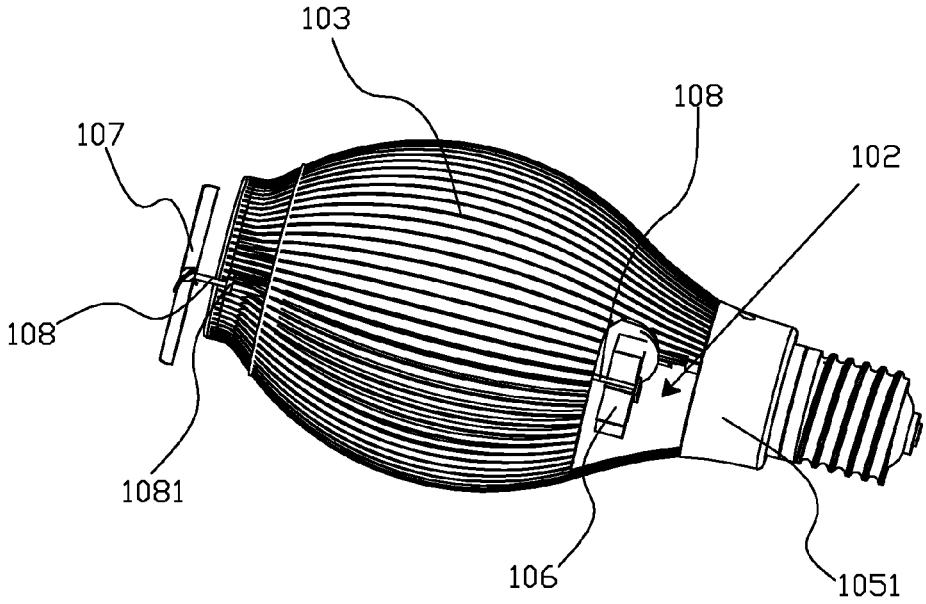
FIG. 1 is a schematic view of a LED street lamp in the first embodiment of the present invention.
Figure 2:
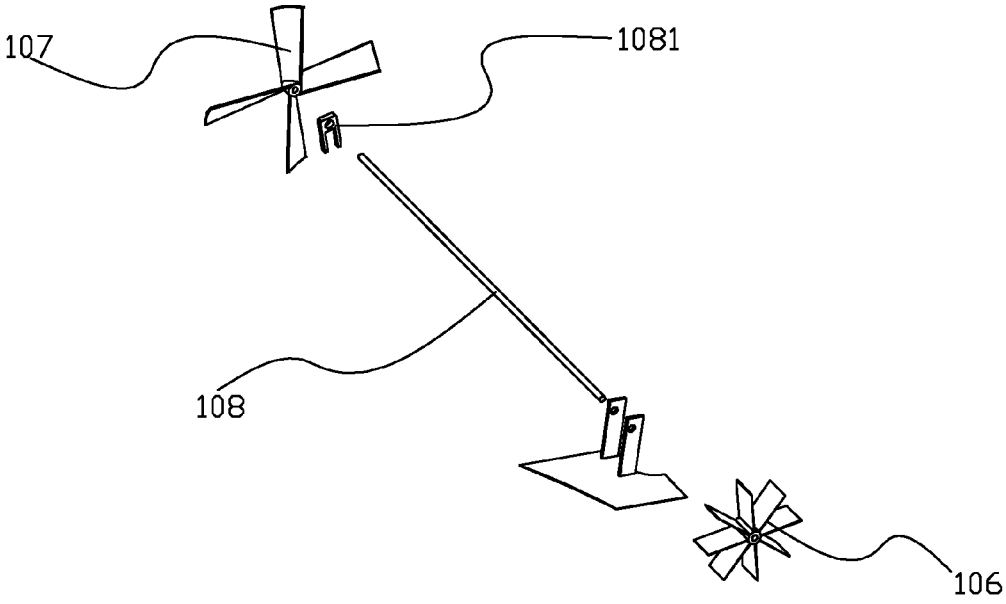
FIG. 2 is an exploded view of a natural convection device and a shaft in the present invention.

FIGS. 1 and 2 illustrate an LED street lamp in the first embodiment of the present invention, comprising a LED module 102 and a heat dissipation device 103 fixed on the back side of the LED module 102, wherein the LED module 102 serving as light source comprises a plurality of LED chips assembled all together through a circuit board and heat pipes, the heat dissipation device 103 may be a common heat sink, such as an aluminum heat sink with fins, in contact with the LED module 102 for absorbing the heat generated by the LED chips in operation. In addition to above, the LED street lamp has a universal lamp cap on the tail thereof, for example, an E40 lamp cap, which is electrically connected with the LED module 102 for power connection, and screwed in a lamp holder for fixation. Moreover, an insulating ring 1051 for preventing electric leakage is disposed in the tail of the street lamp.

There is a first natural convection device 106 mounted between the LED module 102 and the heat dissipation device 103, while a second natural convection device 107 is mounted in front of the LED module 102 and the heat dissipation device 103, these two devices are connected together by a shaft 108 extending between the LED module 102 and the heat dissipation device 103 along a longitudinal direction. The shaft 108 is further connected to the heat dissipation device 103 in a rotatable manner through a rotation connector 1081, which plays a role of fixing the shaft 108 and preventing the shaft 108 from swing in rotation.

In operation the heat generated by the LED module 102 is dissipated by the heat dissipation device 103. Temperature difference between the LED module 102 and the heat dissipation device 103 generates natural convection of air. The first convection device 106 so works relying on this natural convection and accelerates the airflow to a faster speed within the street lamp. In addition, the temperature difference between the lamp body and the external environment generates air natural convection as well: cold air flows in from one end of the street lamp and hot air flows out from another end. The second natural convection device 107 so works to accelerate the airflow as the first natural convection device 106 does. The two natural convection devices in the present invention, as soon as air flows, operate and accelerate the airflow speed.

In practice, for the natural convection devices 106, 107 the static fiction is always greater than the kinetic friction, extra means, such as electronic impulse, magnetomotive force, or Stirling engine, may be needed to help the second natural convection device 107 to overcome the static fiction to start, of course the natural device may be able to start through the chimney effect of natural convection directly.

Figure 3:
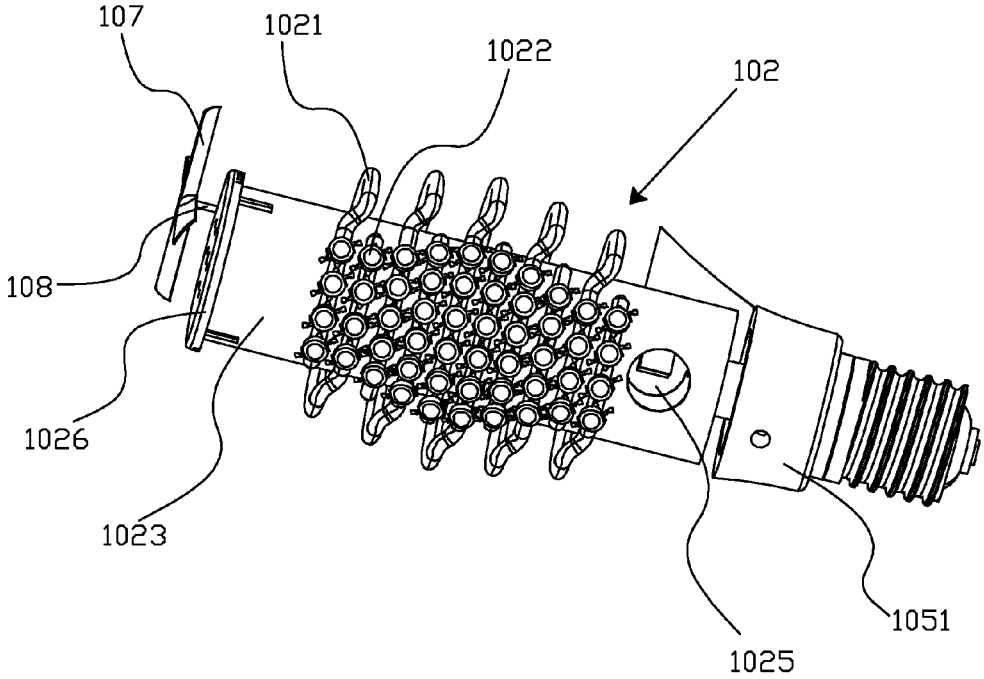
FIG. 3 is an internal schematic view of the LED street lamp in the present invention.
Figure 4:
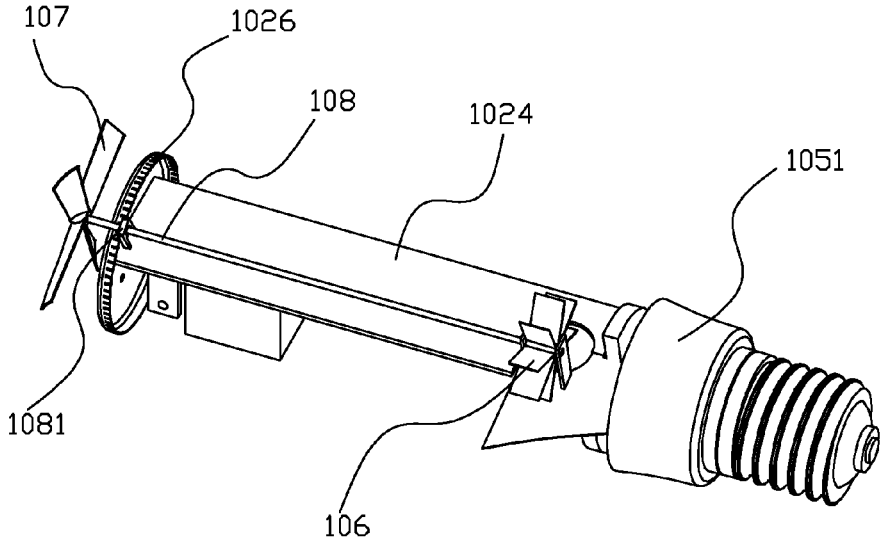
FIG. 4 is a schematic view of the internal elements of a circular tube in the present invention.

The natural convection heat dissipation used in the present invention can accelerate the airflow speed of the whole lamp, consequently to accelerate heat exchange. As shown by FIGS. 3 and 4, in a preferred embodiment of the present invention the LED module 102 consists of heat pipes 1021 and LED chips 1022 mounted on the heat pipes 1021, the heat pipes 1021 surround a circular hollow tube 1023, and a circuit board 1024 with a variety of electronic components electrically connected with the LED chips 1022 outside is disposed in the cavity of the circular tube 1023. Moreover, the circular tube 1023 is further provided with an opening 1025 on the tail thereof, which connects the cavity of the circular tube 1023 to the outside of the street lamp. When the street lamp is operating, cold air goes in through the opening 1025, blows through the electronic components and absorbs heat, finally goes out from the head of the street lamp with the assistance of the second natural convection device 107, the natural air convection within the street lamp is so formed to enhance the heat dissipation of the street lamp, and a stack effect is so formed. In addition to above, a circular tube cover 1026 is placed on the head of the circular tube 1023 for dustproof.

From the above-mentioned discussions, it is apparent that the present invention provides enhanced heat dissipation and consequent extended lifespan, moreover, because of the use of the natural convection devices, the workload for the heat dissipation device is significantly reduced and so that the size and weight of the heat dispensing are accordingly reduced. In this way, the size and weight of the whole street lamp are reduced consequently, whereby easy assembly and use are obtained, and a firmer connection for the street lamp is achieved.

Figure 5:
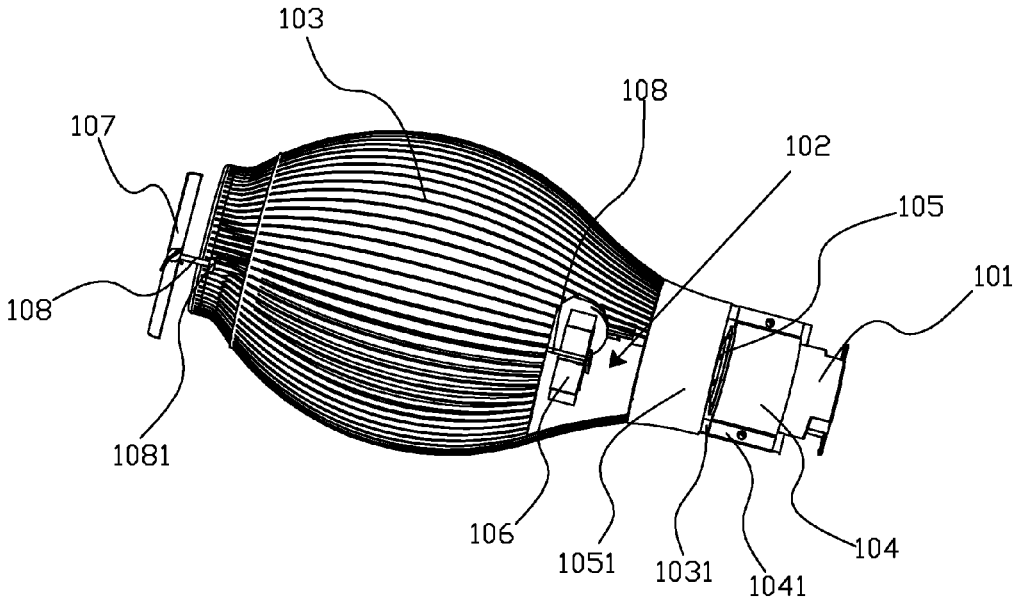
FIG. 5 is a schematic view of the LED street lamp in the second embodiment of the present invention.
Figure 6:
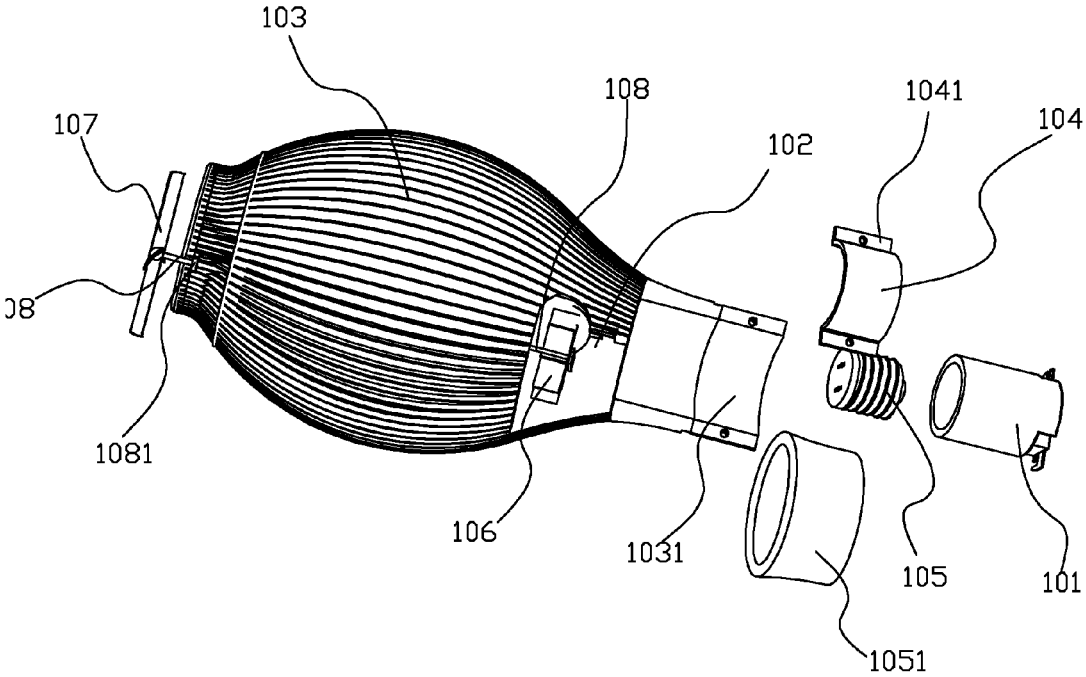
FIG. 6 is an exploded view of the tail of heat dissipation device in the second embodiment of the present invention.

In FIGS. 5 and 6, the construction of the LED street lamp in the second embodiment of the present invention is illustrated, wherein the heat dissipation device 103 is provided with a hemispheric lamp holder mounting recess 1031 for fixing the cup 101. For firmer connection, the lamp holder mounting recess 1031 is combined with a semicircular-arc-like metal plate 104 to form a locking hole for wrapping and locking the lamp holder 101. In assembly locking or releasing the lamp holder 101 is realized by adjusting the tightness of the semicircular-arc-like metal plate 104. In this embodiment, the semicircular-arc-like metal plate 104 is provided with connecting lugs 1041 on the opposite side thereof, which are fixed on opposite sides of the lamp holder mounting recess 1031 through bolts for easy adjusting. In addition, the connector 105 herein is used to fix and electrically connect the lamp holder 101 for power supply. An insulating ring 1051 is mounted between the front part of the connector 105 and the heat dissipation device 103 for preventing electric leakage.

Figure 7:
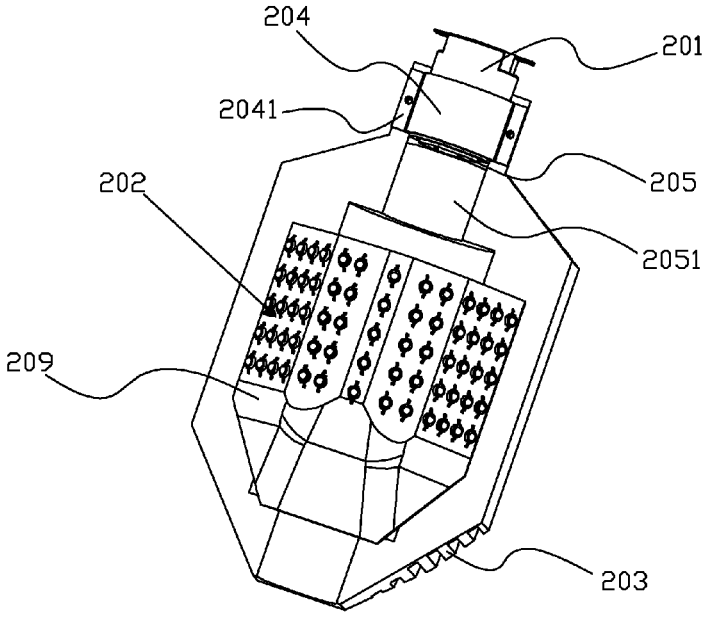
FIG. 7 is a schematic view of a street lamp fixing device according to the present invention.
Figure 8:
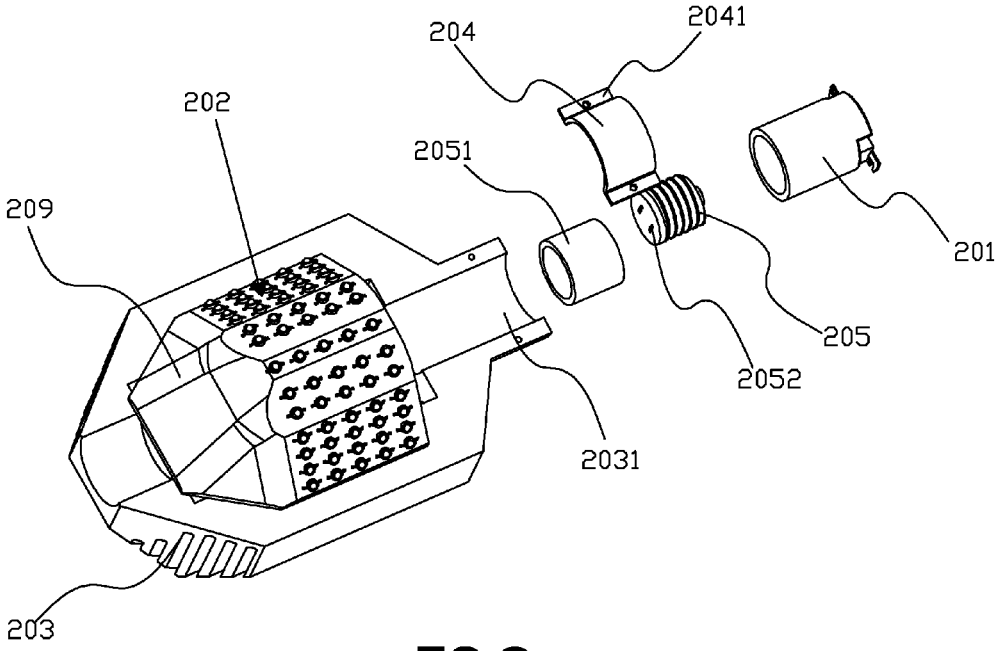
FIG. 8 is an exploded view of the street lamp fixing device according to the present invention.

As shown by FIGS. 6 and 7, the present invention further provides a fixing device for the LED street lamp. In order to describe the fixing device in a convenient way, the fixing device is divided into two main parts: the lamp body and the lamp holder, wherein the lamp body comprises an LED module 202 serving as light source, comprising a plurality of LED chips assembled all together through for example, a circuit board. In a preferred embodiment of the present invention, the LED module 202 mainly comprises heat pipes 2021 and LED chips 2022, its construction can refer to the LED street lamp described above. In addition to above, a transparent protective covering 209 is adopted and mounted on the LED module 202 to protect the LED chips 2022.

The lamp body further comprises a heat dissipation device 203 mounted on the back side of the LED module 202, for example, the heat dissipation device 203 can be a common aluminum heat sink with fins.

In addition to above, the lamp holder 201 for fixing the lamp body in a specified place is fully compliant with the international standards in relevant fields, for example, it could be an E40 lamp holder having a tubular shape, an internal thread, and a common configuration of cathode and anode inside for electrical connection to the lamp head. In assembly, the lamp holder 201 is first fixed in a specified place, the conductive leads are derivate from the lamp holder 201 to connect power supply network, the fixation of the lamp holder 201 in the street lamp base could be permanent, and when used, only lamp body is required to be installed or changed in case.

For fixing the lamp body to the lamp holder 201 in a firmer manner, the apparatuses used in the present invention includes a semicircular-arc-metal plate 204, comprising a connecting lug 2041 on either side thereof, and a connector 205 electrically connecting the lamp bulb to the lamp holder. The connector 205 is provided with an external thread corresponding to the internal thread of the lamp holder 201 for a fixed connection, the connector 205 is equal to the lamp cap in conventional street lamps, and screwed in the lamp holder 201 to realize electrical connection between the lamp bulb and external power source. In this embodiment, the connector 205 further has an electrically connecting site 2052 on the front end thereof for the electrical connection to the LED module 202. In addition, an insulating ring 2051 is disposed between the front end of the connector 205 and the heat dissipation device 203 for preventing electric leakage.

The heat dissipation device 203 is provided with a hemispherical lamp mounting recess 2031 cooperated with the semicircular-arc-like metal plate 204 to form a circular locking hole for wrapping and locking the lamp holder 201. The connecting lugs 2041 of the metal plate 204 are fixed on the opposite sides of the hemispherical lamp holder mounting recess 2031. Preferably, the fixed connection between the metal plate 204 and the hemispherical lamp holder mounting recess 2031 is realized by bolts and nuts. In this way, through adjusting the tightness of the locking hole, the lamp holder 201 can be locked or released. Moreover, as the preferred metal plate 204 is designed to wrap the lamp holder 201 partially, it is easy to adjust the position of the lamp body.

In the present invention, the lamp holder 201 is serving as a fixing end connecting the lamp body to a lamp base. In this embodiment, the lamp body consists of the LED module 202, the heat dissipation device 203 and the connector 205, the lamp holder 201 is wrapped and locked by the metal plate 204 and the lamp holder mounting recess 2031 on the tail of the heat dissipation device 203, a tight connection is so formed for the whole street lamp. In general, with this configuration an E40 lamp holder could afford a weight of more than 10 kg, and the installation becomes relatively easier as well.

Figure 9:
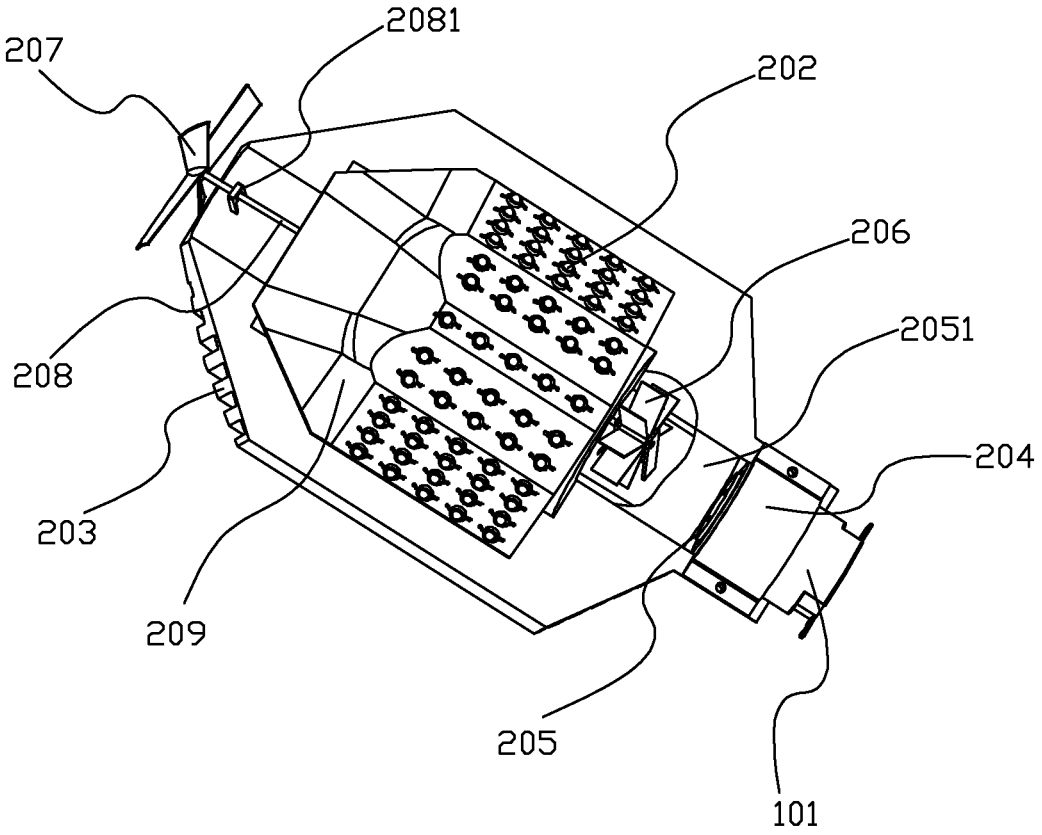
FIG. 9 is a schematic view of another fixing device according to the present invention.

As shown by FIG. 9, as a preferred embodiment, the second embodiment is developed based on the first embodiment, comprising:

a first natural convection device 206 disposed between the LED module 202 and the heat dissipation device 203, and actuated by natural air convection generated by the temperature difference between the LED module 202 and the exterior of the lamp; and a second natural convection device 207 disposed outside the LED module 202 and the heat dissipation device 203, and actuated by natural air convection generated by the temperature difference between the LED module 202 and the heat dissipation device 203.

The first and second natural convection devices are both driven by natural air convection produced by temperature difference.

The two natural convection devices are connected with each other through a shaft 208 disposed between the LED module 202 and the heat dissipation device 203 along a longitudinal direction, wherein the shaft 208 is also connected with the heat dissipation device 203 in a rotatable manner through a rotation connector 2081, here the rotation connector 2081 is used to fix the shaft 208 and prevent the shaft 208 from swing.

In practice, for the natural convection devices in this embodiment static fiction is always greater than kinetic friction, an extra means may be needed to help the second natural convection device to start against static fiction, this extra means could be electronic impulse, magneto motive force, or Stirling engine, of course, the device can also be started by the chimney effect of natural convection directly.

The heat dissipation way of natural convection used in the second embodiment allows quicker airflow, and consequent accelerated heat exchange, thereby not only providing better heat dissipation and extended the lifespan of the street lamp, but also reducing the size and weight of the heat dissipation device and so that the size and weight of the whole street lamp is significantly reduced. Moreover the present invention provides a firm mounting structure for the LED street lamp, and makes the whole device more convenient in assembly and use.

The above-mentioned preferred embodiments are only used as examples for illustrating the present invention. It is understood that various modifications or alterations to the described embodiments for those skilled in the art are intended to be within the spirit and scope of the present invention. The present invention should not be limited in the described embodiments here but should be referred by its claims. The present invention should be understood to cover all aspects of the invention, such as various modifications or equivalent alterations which are not deviated from the scope and spirit of the present invention.

What is claimed is:

1. A light-emitting diode (LED) street lamp, comprising:

an LED module;

a heat dissipation device secured on the back side of the LED module;

a first natural convection device disposed between the LED module and the heat dissipation device, and actuated by air natural convection generated by the temperature difference between the LED module and the heat dissipation device;

a second natural convection device disposed outside the LED module and the heat dissipation device, and actuated by air natural convection generated by the temperature difference between the LED module and the outside of the street lamp; and a shaft mounted between the LED module and the heat dissipation device along a longitudinal direction, and connecting the first and second natural convection devices.

2. The LED street lamp according to claim 1, wherein the heat dissipation device has a hemispherical lamp holder mounting recess on the tail thereof for receiving a lamp holder.

3. The LED street lamp according to claim 2, wherein the lamp holder mounting recess is cooperated with a semicircular-arc-like metal plate to form a locking hole for wrapping and locking a lamp holder, the metal plate has connecting lugs on the opposite sites thereof fixedly connected to the opposite sides of the lamp holder mounting recess respectively.

4. The LED street lamp according to claim 1, wherein the heat dissipation device has a hemispherical lamp holder mounting recess on the tail thereof for receiving a lamp holder.

5. The LED street lamp according to claim 4, wherein the lamp holder mounting recess is cooperated with a semicircular-arc-like metal plate to form a locking hole for wrapping and locking a lamp holder, the metal plate has connecting lugs on the opposite sites thereof fixedly connected to the opposite sides of the lamp holder mounting recess respectively.

6. The LED street lamp according to claim 1, wherein the LED module comprises heat pipes and LED chips mounted on the heat pipes, the heat pipes surround a hollow circular tube, a circuit board electrically connected with the LED chips and disposed in the cavity of the circular tube, the circular tube has an opening on the sidewall thereof connecting the cavity of the circular tube to the outside of the LED street lamp, a tube cover is mounted on the head of the circular tube.

7. A street lamp fixing device, comprising:

an LED module;

a heat dissipation device secured on the back side of the LED module;

a standard circular lamp holder with an internal thread;

a semicircular-arc-like metal plate with an connecting lug on either side thereof;

a connector electrically connecting the LED module and the lamp holder, and with an external thread corresponding to the internal thread of the lamp holder; the heat dissipation device has a hemispherical lamp holder mounting recess cooperated with the metal plate, to form a locking hole for wrapping and locking the lamp holder; the connecting lugs of the metal plate are respectively fixed on the opposite sides of the lamp holder mounting recess;

a first natural convection device disposed between the LED module and the heat dissipation device, and actuated by air natural convection generated by the temperature difference between the LED module and the heat dissipation device;

a second natural convection device disposed outside the LED module and the heat dissipation device, and actuated by air natural convection generated by the temperature difference between the LED module and the outside of the street lamp; and a shaft mounted between the LED module and the heat dissipation device along a longitudinal direction, and connecting the first and second natural convection devices.

8. The street lamp fixing device according to claim 7, wherein the connecting lugs of the metal plate are respectively fixed on the opposite sides of the lamp holder mounting recess through bolts.

9. The street lamp fixing device according to claim 7, wherein the LED module has a transparent protective covering in front thereof.

* * * * *